US006102516A

United States Patent [19]

Gibson

[11] Patent Number: 6,102,516

[45] Date of Patent: Aug. 15, 2000

[54] FIDUCIAL SYSTEM AND METHOD FOR CONDUCTING AN INSPECTION TO DETERMINE IF A SECOND ELEMENT IS PROPERLY ALIGNED RELATIVE TO A FIRST ELEMENT

[75] Inventor: Bruce David Gibson, Lexington, Ky.

[73] Assignee: Lexmark International, Inc., Lexingtion, Ky.

[21] Appl. No.: 08/818,689

[22] Filed: Mar. 17, 1997

[51] Int. Cl.[7] ..... B41J 2/16

[52] U.S. Cl. ..... 347/19; 356/396

[58] Field of Search ..... 347/19, 61, 67, 347/20, 40, 47, 49; 257/797; 356/396

[56] References Cited

U.S. PATENT DOCUMENTS

| | | | |
|---|---|---|---|
| 3,388,262 | 6/1968 | Stutz . | |
| 3,560,097 | 2/1971 | Gavrilkin et al. . | |
| 4,423,127 | 12/1983 | Fujimara | 430/22 |
| 4,643,579 | 2/1987 | Toriumi et al. . | |
| 4,768,883 | 9/1988 | Waldo et al. | 356/399 |
| 5,075,201 | 12/1991 | Koh | 430/321 |
| 5,450,109 | 9/1995 | Hock | 347/67 |
| 5,500,736 | 3/1996 | Koitabashi et al. | 356/375 |
| 5,942,805 | 8/1999 | Winer et al | 257/797 |

FOREIGN PATENT DOCUMENTS

| | | |
|---|---|---|
| 0 624 472 | 11/1794 | European Pat. Off. . |
| 0 269 076 | 6/1988 | European Pat. Off. . |
| 0 564 080 | 10/1993 | European Pat. Off. . |
| 3-165600 | 11/1989 | Japan . |
| 2-033997 | 2/1990 | Japan . |
| 8-125396 | 5/1996 | Japan . |

*Primary Examiner*—Robert Beatty
*Attorney, Agent, or Firm*—John A. Brady

[57] ABSTRACT

A fiducial system is provided for use during an alignment inspection of first and second adjacent elements. The fiducial system comprises an inspection opening in the second element. It further comprises first and second fiducial portions on the first element positioned and sized to provide an accurate indication when viewed through the inspection opening of whether the second element is properly positioned relative to the first element regardless of the size of the inspection opening as long as the opening has a size greater than or equal to a lower limit dimension. The first element may comprise an ink jet printhead heater chip and the second element may comprise an ink jet printhead nozzle plate.

32 Claims, 4 Drawing Sheets

FIDUCIAL SYSTEM AND METHOD FOR CONDUCTING AN INSPECTION TO DETERMINE IF A SECOND ELEMENT IS PROPERLY ALIGNED RELATIVE TO A FIRST ELEMENT

FIELD OF THE INVENTION

This invention relates to a fiducial system and a method for conducting an inspection using a fiducial system to determine if a second element is properly aligned relative to a first element. More particularly, the instant invention is directed to a fiducial system which is adapted to be used during an inspection to determine if an ink jet printhead nozzle plate is properly aligned relative to an ink jet printhead heater chip.

BACKGROUND OF THE INVENTION

Ink jet printheads typically comprise a nozzle plate joined to a heater chip. During ink jet printhead manufacturing, it is known to inspect assembled printheads on a sampled basis to determine if the nozzle plates are being properly aligned relative to the heater chips. One known inspection technique involves viewing a circular fiducial provided on the heater chip through a circular inspection opening provided in the nozzle plate. If the nozzle plate covers a portion of the circular fiducial such that only a portion of the fiducial is visible through the opening, then an "out of alignment" condition exists. If the entire circular fiducial is visible through the inspection opening, then an "in alignment" condition exists.

Due to manufacturing tolerances, the size of the nozzle plate inspection opening will vary from a nominal size. It has been found that when alignment between the nozzle plate and the heater chip is adequate by a narrow margin, an improper "out of alignment" condition may be indicated if the inspection opening is less than the nominal size but greater than the lower limit dimension. Because of such errors, this inspection technique is not preferred.

It is desirable to obtain accurate assessments of alignment with respect to, for example, nozzle plates and heater chips in order to ensure good print quality in ink jet printers.

SUMMARY OF THE INVENTION

The instant invention is directed to a fiducial system adapted for use during an alignment inspection of first and second adjacent elements. The fiducial system comprises an inspection opening in the second element. It further comprises a fiducial pattern including first and second fiducial portions on the first element positioned and sized to provide an accurate indication when viewed through the inspection opening of whether the second element is properly positioned relative to the first element regardless of the size of the inspection opening as long as the opening has a size greater than or equal to a lower limit dimension. The first element may comprise an ink jet printhead heater chip and the second element may comprise an ink jet printhead nozzle plate.

The fiducial portions may comprise spaced-apart solid or dotted lines or may comprise portions of a single fiducial body. Preferably, each of the first and second fiducial portions has a length approximately equal to twice an inspection criterion. The inspection criterion is equal to an acceptable dimension by which the second element may be offset relative to the first element in a direction along a common axis.

DETAILED DESCRIPTION OF THE PREFERRED EMBODIMENT

Figure 1:
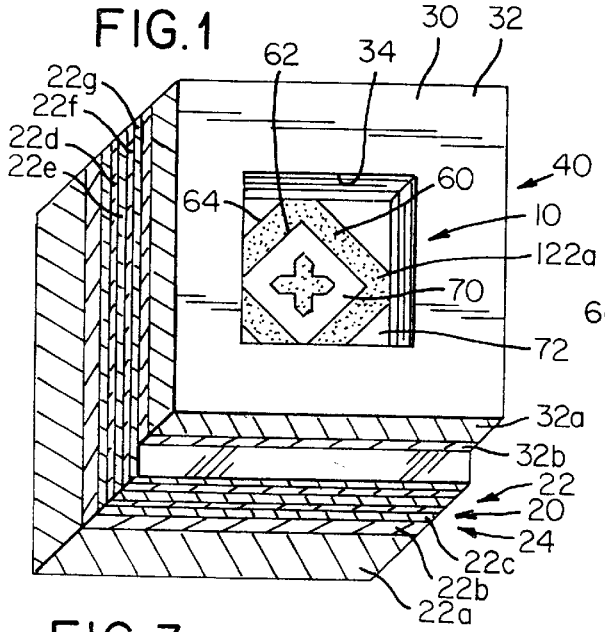
FIG. 1 is a schematic sectional perspective view illustrating a portion of an ink jet printhead provided with a fiducial system of the present invention.

Referring now to FIG. 1, a fiducial system 10 is shown for use during an alignment inspection of first and second elements 20 and 30. In the illustrated embodiment, the first element 20 comprises an ink jet printhead heater chip 22 and the second element 30 comprises and ink jet printhead nozzle plate 32. The nozzle plate 32 is aligned and may be bonded to the heater chip 22 via any art recognized technique including a thermocompression bonding process. The joined heater chip 22 and nozzle plate 32 comprise an ink jet printhead 40.

In the illustrated embodiment, the nozzle plate 32 comprises a polymeric layer 32*a*, such as a polyimide layer, and a phenolic butryl adhesive layer 32*b*. The phenolic butryl adhesive layer 32*b* bonds directly to the heater chip 22 during the thermocompression bonding process. The specific nozzle plate layers, their arrangement and the materials from which these layers are formed are mentioned herein for illustrative purposes only. Hence, in this invention, the number of nozzle plate layers, their arrangement and the materials from which these layers are formed are not intended to be limited to the specific ones disclosed herein.

The nozzle plate 32 is formed having a plurality of openings (not shown). When the plate 32 is bonded to the heater chip 22, sections (not shown) of the plate 32 and portions (not shown) of the heater chip 22 define a plurality of ink-receiving bubble chambers. Each bubble chamber communicates with an ink ejecting nozzle defined by one of the nozzle plate openings through which droplets of ink are expelled.

Figure 1A:
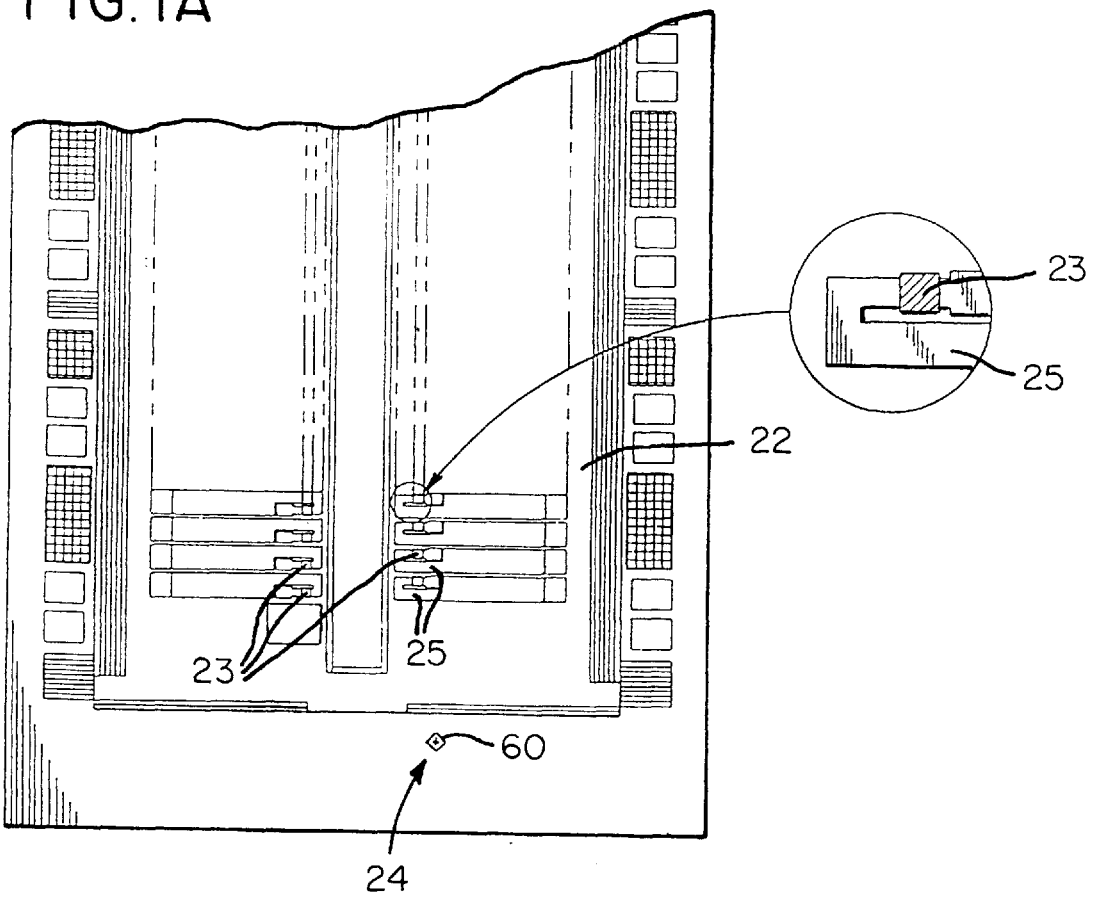
FIG. 1A is a plan view of a portion of a heater chip including a fiducial body formed in accordance with the present invention.

The heater chip 22 comprises a plurality of resistive heating elements 23 and conductive traces 25, see FIG. 1A. The resistive heating elements 23 are positioned on the chip 22 so that once the nozzle plate 32 is bonded to the chip 22 each heating element 23 is located within one of the ink-receiving chambers. The resistive heating elements 23 are individually addressed by power pulses. Each power pulse is applied to a heating element 23 to momentarily vaporize the ink in contact with the heating element 23 to form a bubble within the chamber in which the heating element is located. The function of the bubble is to displace ink within the chamber such that a droplet of ink is expelled from the nozzle.

The fiducial system 10 comprises an inspection opening 34 formed in the nozzle plate 32. In the illustrated embodiment, the inspection opening 34 is square in shape. However, the opening 34 may have any other geometric shape. For example, the opening 34 may be shaped as a circle, a rectangle, an oval, an octagon, or a hexagon.

The fiducial system 10 further comprises first, second, third and fourth fiducial portions 50–53 provided on the heater chip 22. As will be discussed further below, the fiducial portions 50–53 are positioned on the chip 22 and sized to provide an accurate indication when viewed through the nozzle plate inspection opening 34 of whether the nozzle plate 32 is properly positioned relative to the heater chip 22 regardless of the size of the inspection opening 34 as long as the opening 34 has dimensions which are greater than or equal to lower limit dimensions or values.

In the illustrated embodiment, the fiducial portions 50–53 comprise portions of a first fiducial body 60 provided on the heater chip 22. The fiducial body 60 has an inner square-shaped boundary 62 and an outer square-shaped boundary 64. The inner and outer square-shaped boundaries 62 and 64 of the fiducial body 60 are rotated approximately 90° to the square inspection opening 34, see FIG. 2. The shape of the inner and outer boundaries of the fiducial body 60 may be of any geometric shape. For example, they may be shaped as a circle, a rectangle, an oval, an octagon, or a hexagon. Further, they may have a shape which differs from the shape of the inspection opening 34.

The first fiducial portion 50 extends from a first corner 64*a* of the outer square-shaped boundary 64 to a first corner 62*a* of the inner square-shaped boundary 62. The second fiducial portion 51 extends from a second corner 64*b* of the outer square-shaped boundary 64 to a second corner 62*b* of the inner square-shaped boundary 62. The third fiducial portion 52 extends from a third corner 64*c* of the outer square-shaped boundary 64 to a third corner 62*c* of the inner square-shaped boundary 62. The fourth fiducial portion 53 extends from a fourth corner 64*d* of the outer square-shaped boundary 64 to a fourth corner 62*d* of the inner square-shaped boundary 62. The first and second fiducial portions 50 and 51 are located along a common first axis $A_1$, see FIG. 2. The third and fourth fiducial portions 52 and 53 are located along a common second axis $A_2$.

The region 24 of the heater chip 22 where the fiducial body 60 is located comprises a silicon-comprising substrate 22*a*, see FIG. 1. A silicon dioxide layer 22*b* is provided over the substrate 22*a* followed by a silicon glass layer 22*c*. The latter two layers 22*b* and 22*c* are semi-transparent and comprise electrical insulating layers. A patterned heat-generating resistance layer 22*d* formed from an alloy of tantalum and aluminum is provided over the silicon glass layer 22*c*. The resistive heating elements 23 are formed from this layer 22*d*. A patterned conductive layer 22*e* formed from an alloy of aluminum and copper is formed over the resistance layer 22*d*. The conductive traces 25, which provide the power pulses to the resistive heating elements 23, are formed from this layer 22*e*. Protective layers 22*f* and 22*g* of silicon nitride and silicon carbide, respectively, are provided over the conductive layer 22*e*. The protective layers 22*f* and 22*g* are fairly transparent. The specific number of heater chip layers, their arrangement and materials from which these layers are formed are mentioned herein for illustrative purposes only. Hence, in this invention, the number of heater chip layers, their arrangement and the materials from which these layers are formed are not intended to be limited to the specific ones disclosed herein.

The fiducial body 60 is formed via a conventional etching process through the resistance and conductive layers 22*d* and 22*e*. Thus, the fiducial body 60 is defined by a portion 122*a* of the silicon substrate 22*a* which is visible through the protective layers 22*f* and 22*g* and the silicon dioxide and silicon glass layers 22*b* and 22*c*, see FIG. 1. The fiducial body 60 is surrounded by non-etched inner and outer reflective conductive layer portions 70 and 72. Accordingly, the body 60 will have a first color or appearance which is clearly distinguishable from a second color or appearance of the conductive layer portions 70 and 72 surrounding the main body 60.

Figure 3:
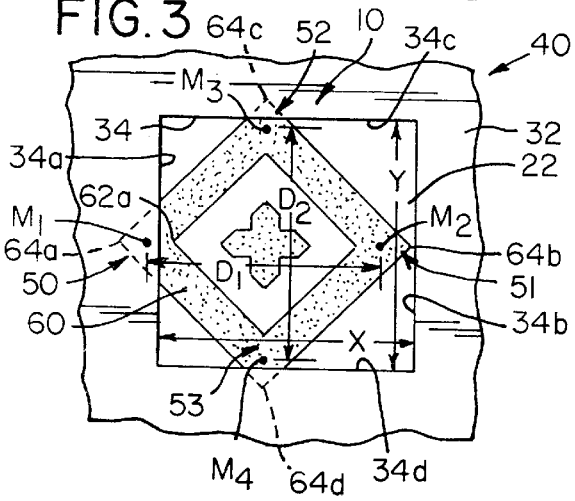

The inspection opening 34 has a first dimension X which varies between upper and lower limit dimensions or values and a second dimension Y which varies between upper and lower limit dimensions or values, see FIG. 3.

Figure 2:
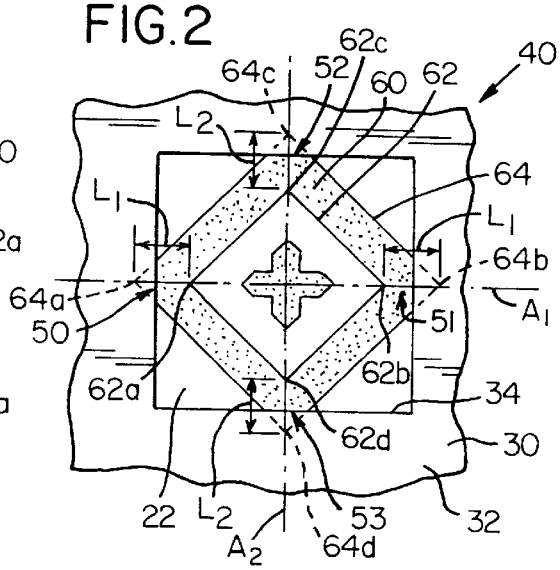
FIGS. 2–13 are schematic plan views of ink jet printheads comprising nozzle plates and heater chips having different alignments.

Each of the first and second fiducial portions 50 and 51 has a length $L_1$ which is equal to approximately twice an acceptable dimension or tolerance by which the nozzle plate 32 may be offset relative to the heater chip 22 in a direction along the first axis $A_1$, see FIG. 2. Each of the third and fourth fiducial portions 52 and 53 has a length $L_2$ which is equal to approximately twice an acceptable dimension by which the nozzle plate 32 may be offset relative to the heater chip 22 in a direction along the second axis $A_2$. $L_1$ may be equal to $L_2$ or may be less than or greater than $L_2$.

The distance $D_1$ between a midpoint $M_1$ on the first fiducial portion 50 and a midpoint $M_2$ on the second fiducial portion 51 is approximately equal to the lower limit value of the first dimension X of the inspection opening 34, see FIG. 3. The distance $D_2$ between a midpoint $M_3$ on the third fiducial portion 52 and a midpoint $M_4$ on the fourth fiducial portion 53 is approximately equal to the lower limit value of the second dimension Y of the inspection opening 34.

Dimensions of an example fiducial system 10 will now be described. These dimensions are being presented for purposes of illustration only and are not limiting. The first and second dimensions X and Y of the inspection opening 34 are equal to 100±4 microns. Thus, the first dimension X has a nominal dimension of 100 microns, a lower limit dimension of 96 microns and an upper limit dimension of 104 microns. The second dimension Y has a nominal dimension of 100 microns, a lower limit dimension of 96 microns and an upper limit dimension of 104 microns. The length $L_1$ of each of the first and second fiducial portions 50 and 51 is equal to 20 microns and the length $L_2$ of each of the third and fourth fiducial portions 52 and 53 is equal to 20 microns. Thus, in this example, the acceptable distance that the nozzle plate 32 may be offset relative to the heater chip 22 along both the $A_1$ and $A_2$ axes is approximately 10 microns. Distances $D_1$ and $D_2$ are equal to approximately 96 microns.

Use of the fiducial system 10 will now be described.

The fiducial portions 50–53 are viewed through the inspection opening 34 using, for example, a video microscope (not shown) which generates an output signal provided to either a monitor for analysis by human vision or to an optical analyzer for analysis by an electronic device. It is also contemplated that an operator may view the fiducial portions 50–53 through an eyepiece of a standard microscope. A determination is then made from the location of the first, second, third and fourth fiducial portions 50–53 and first, second, third and fourth edges 34*a*–34*d* of the inspection opening 34 whether the heater chip 22 and the nozzle plate 32 are properly aligned relative to one another.

The alignment determination requires that one or more of the following three inquiries be made. The first inquiry is whether the first, second, third and fourth outer square-shaped boundary corners 64*a*–64*d* are covered by the nozzle plate 32. If all of the outer square-shaped boundary corners 64*a*–64*d* are covered by the nozzle plate 32 and, hence, are not visible through the inspection opening 34, then the alignment between the heater chip 22 and the nozzle plate 32 is acceptable and no further inquiries need be made. If the first and second outer square-shaped boundary corners 64*a* and 64*b* are covered by the nozzle plate 32 and one of the third and fourth outer square-shaped boundary corners 64*c* and 64*d* is not covered by the nozzle plate 32, then alignment is proper along the first axis $A_1$ and a second inquiry must be made regarding alignment along the second axis $A_2$. If the third and fourth outer square-shaped boundary corners 64*c* and 64*d* are covered by the nozzle plate 32 and one of the first and second outer square-shaped boundary corners 64*a* and 64*b* is not covered by the nozzle plate 32, then alignment is proper along the second axis $A_2$ and a second inquiry must be made regarding alignment along the first axis $A_1$. If one of the first and second outer square-shaped boundary corners 64*a* and 64*b* is not covered by the nozzle plate 32 and one of the third and fourth outer square-shaped boundary corners 64*c* and 64*d* is not covered by the nozzle plate 32, then a second inquiry must be made regarding alignment along both the first and second axes $A_1$ and $A_2$.

The second inquiry is whether the nozzle plate 32 covers any portion of any one of the inner square-shaped boundary corners 62*a*–62*d*. If the nozzle plate 32 covers one of the first and second inner square-shaped boundary corners 62*a* or 62*b*, then alignment is improper along the first axis $A_1$. If the nozzle plate 32 covers one of the third and fourth inner square-shaped boundary corners 62*c* or 62*d*, then alignment is improper along the second axis $A_2$. The nozzle plate 32 is improperly aligned relative to the heater chip 22 if alignment is improper along either the first axis $A_1$ or the second axis $A_2$. If the nozzle plate 32 does not cover any portion of any one of the inner square-shaped boundary corners 62*a*–62*d*, then a third inquiry is made.

The third inquiry is performed with regard to alignment along one or both of the $A_1$ and $A_2$ axes. The inquiry is whether a gap or distance between one inspection opening edge and a visible outer square-shaped boundary corner (or the outer square-shaped boundary corner which is nearest to the inspection opening along the axis being evaluated) is greater than, equal to or less than a gap or distance between an opposing inspection opening edge and an opposing inner square-shaped boundary corner. The alignment is acceptable along the direction or axis being evaluated if the gap between the one inspection opening edge and the visible outer square-shaped boundary corner is less than or equal to the gap between the opposing inspection opening edge and the opposing inner square-shaped boundary corner. The alignment is unacceptable if the gap between the one inspection opening edge and the visible outer square-shaped boundary corner is greater than the gap between the opposing inspection opening edge and the opposing inner square-shaped boundary corner.

In FIGS. 2–13, ink jet printheads 40 comprising joined nozzle plates 32 and heater chips 22 having different alignment conditions are schematically shown. Each will now be discussed.

In FIG. 2, each of the outer square-shaped boundary corners 64*a*–64*d* is covered by the nozzle plate 32. Accordingly, the alignment between the heater chip 22 and the nozzle plate 32 is acceptable.

In FIG. 3, the gap between the inspection opening edge 34*b* and the visible outer square-shaped boundary corner 64*b* is less than the gap between the opposing inspection opening edge 34*a* and the opposing inner square-shaped boundary corner 62*a*. Hence, alignment is proper along the first axis $A_1$. Alignment along the second axis $A_2$ is also proper as the third and fourth outer square-shaped boundary corners 64*c* and 64*d* are covered by the nozzle plate 32. Hence, the nozzle plate 32 is properly aligned relative to the heater chip 22.

Figure 4:
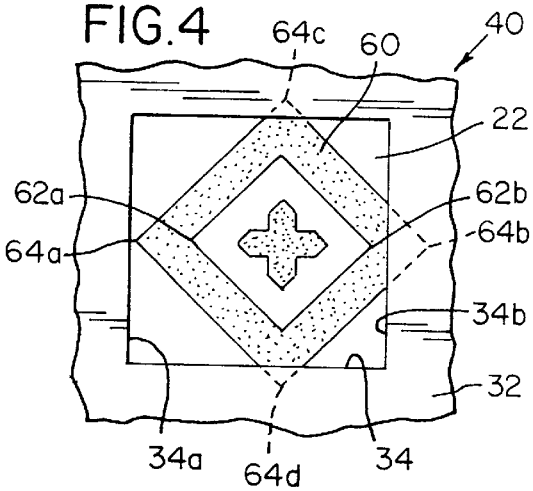

In FIG. 4, the gap between the inspection opening edge 34*a* and the visible outer square-shaped boundary corner 64*a* is less than the gap between the opposing inspection opening edge 34*b* and the inner square-shaped boundary corner 62*b*. Hence, alignment is proper along the first axis $A_1$. Alignment along the second axis $A_2$ is also proper as the third and fourth outer square-shaped boundary corners 64*c* and 64*d* are covered by the nozzle plate 32.

Figure 5:
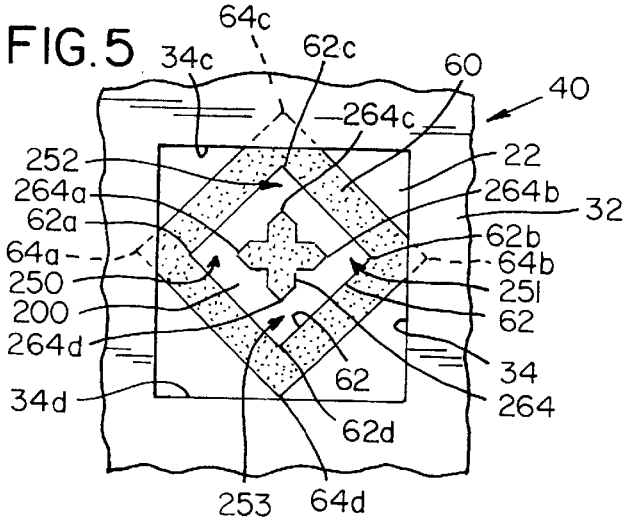

In FIG. 5, alignment along the first axis $A_1$ is proper as the first and second outer square-shaped boundary corners 64*a* and 64*b* are covered by the nozzle plate 32. With regard to alignment along the second axis $A_2$, the gap between the inspection opening edge 34*d* and the visible outer square-shaped boundary corner 64*d* is less than the gap between the opposing inspection opening edge 34*c* and the inner square-shaped boundary corner 62*c*. Hence, alignment is also proper along the second axis $A_2$.

Figure 6:
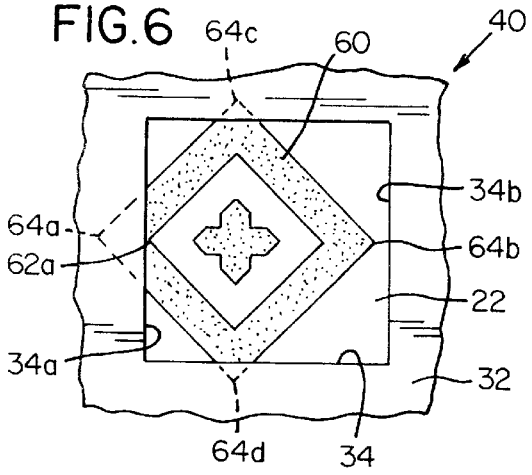

In FIG. 6, the gap between the inspection opening edge 34*b* and the visible outer square-shaped boundary corner 64*b* is greater than the gap between the opposing inspection opening edge 34*a* and the opposing inner square-shaped boundary corner 62*a*. Hence, alignment is improper along the first axis $A_1$. Alignment along the second axis $A_2$ is proper as the third and fourth outer square-shaped boundary corners 64*c* and 64*d* are covered by the nozzle plate 32. Because alignment is improper along the first axis $A_1$, the overall alignment of the nozzle plate 32 relative to the heater chip 22 is considered to be unacceptable.

Figure 7:
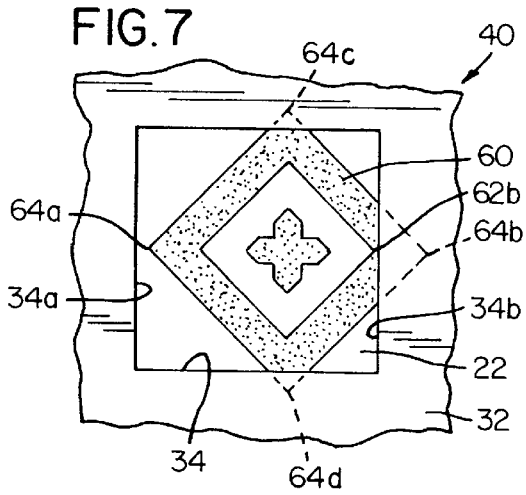

In FIG. 7, the gap between the inspection opening edge 34*a* and the visible outer square-shaped boundary corner 64*a* is greater than the gap between the opposing inspection opening edge 34*b* and the opposing inner square-shaped boundary corner 62*b*. Hence, alignment is improper along the first axis $A_1$. Alignment along the second axis $A_2$ is proper as the third and fourth outer square-shaped boundary corners 64*c* and 64*d* are covered by the nozzle plate 32. Because alignment is improper along the first axis $A_1$, the overall alignment of the nozzle plate 32 relative to the heater chip 22 is considered to be unacceptable.

Figure 8:
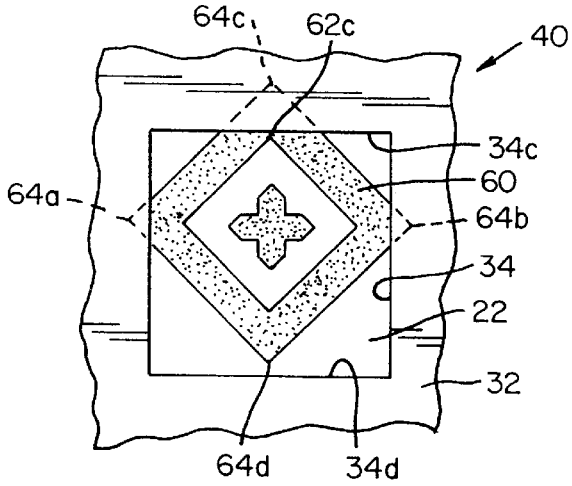

In FIG. 8, alignment along the first axis $A_1$ is proper as the first and second outer square-shaped boundary corners 64*a* and 64*b* are covered by the nozzle plate 32. With regard to alignment along the second axis $A_2$, the gap between the inspection opening edge 34*d* and the visible outer square-shaped boundary corner 64*d* is greater than the gap between the opposing inspection opening edge 34*c* and the inner square-shaped boundary corner 62*c*. Hence, alignment is improper along the second axis $A_2$.

Figure 9:
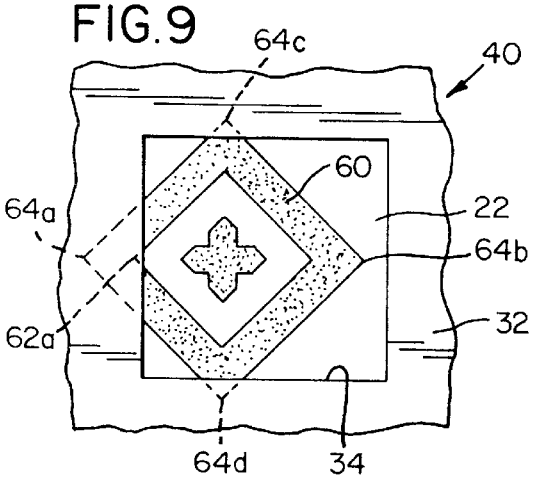

In FIG. 9, the nozzle plate 32 covers the inner square-shaped boundary corner 62*a*. Hence, alignment along the first axis $A_1$ is improper. Alignment is proper along the second axis $A_2$ as the third and fourth outer square-shaped boundary corners 64*c* and 64*d* are covered by the nozzle plate 32. Because alignment is improper along the first axis $A_1$, the overall alignment of the nozzle plate 32 relative to the heater chip 22 is considered to be unacceptable.

Figure 10:
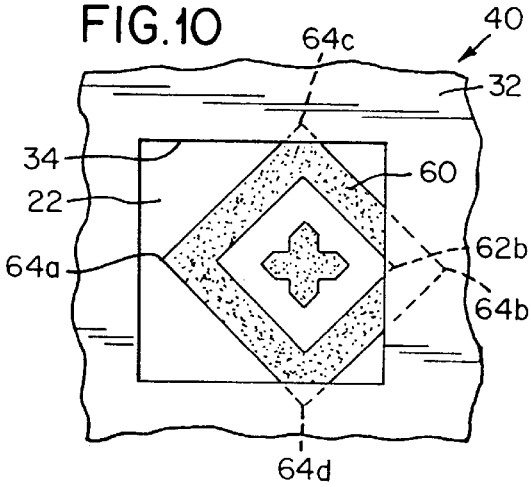

In FIG. 10, the nozzle plate 32 covers the inner square-shaped boundary corner 62*b*. Hence, alignment along the first axis $A_1$ is improper. Alignment is proper along the second axis $A_2$ as the third and fourth outer square-shaped boundary corners 64*c* and 64*d* are covered by the nozzle plate 32. Because alignment is improper along the first axis $A_1$, the overall alignment of the nozzle plate 32 relative to the heater chip 22 is considered to be unacceptable.

Figure 11:
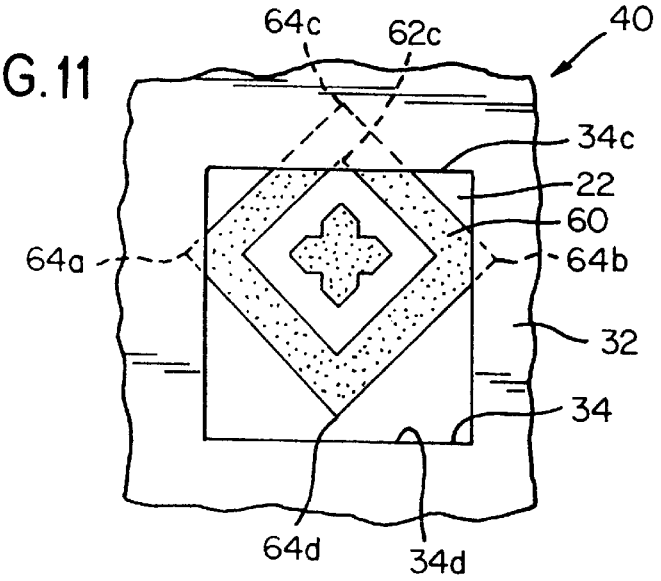

In FIG. 11, alignment along the first axis $A_1$ is proper as the first and second outer square-shaped boundary corners 64*a* and 64*b* are covered by the nozzle plate 32. With regard to alignment along the second axis $A_2$, the nozzle plate 32 covers the inner square-shaped boundary corner 62*c*. Hence, alignment along the second axis $A_2$ is improper.

Figure 12:
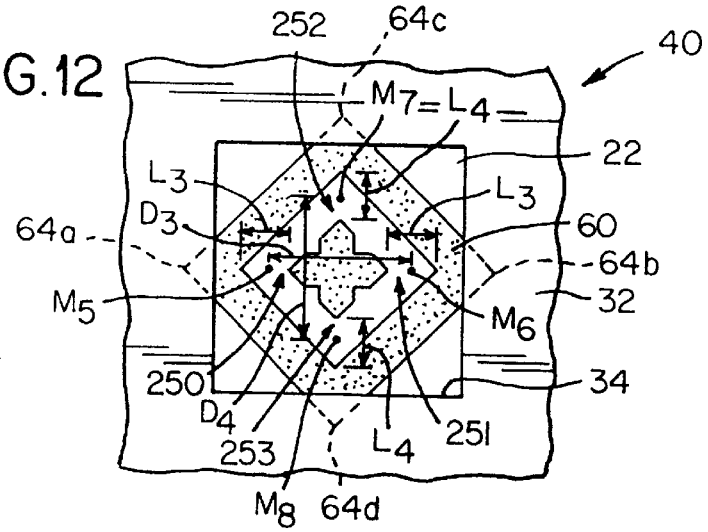

In FIG. 12, the nozzle plate opening 34 has X and Y dimensions which are less than the X and Y dimensions of the openings 34 illustrated in FIGS. 2–11. Alignment between the nozzle plate 32 and the heater chip 22 shown in FIG. 12 is considered to be proper as each of the outer square-shaped boundary corners 64*a*–64*d* is covered by the nozzle plate 32.

Figure 13:
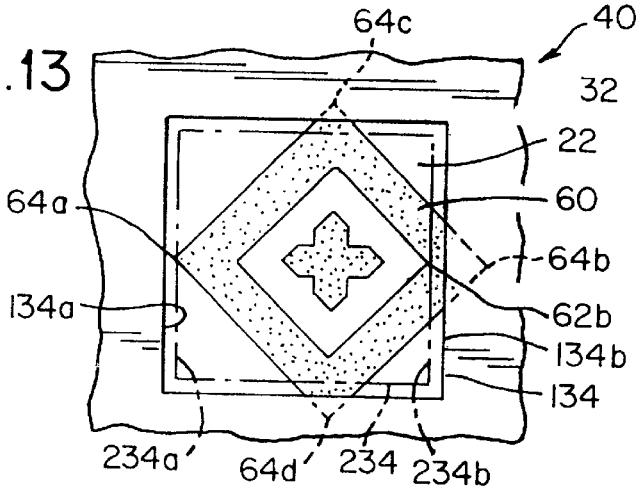

In FIG. 13, a first nozzle plate opening 134 is shown in solid line which has X and Y dimensions equal to upper limit dimensions or values for the inspection opening. The X and Y dimensions of the opening 134 are greater than the X and Y dimensions of the openings 34 illustrated in FIGS. 2–12. A second nozzle plate opening 234 is shown in phantom in FIG. 13 having X and Y dimensions equal to lower limit dimensions or values for the inspection opening.

When the fiducial body 60 is viewed through the first inspection opening 134, the gap between the inspection opening edge 134*a* and the visible outer square-shaped boundary corner 64*a* is less than the gap between the opposing inspection opening edge 134*b* and the inner square-shaped boundary corner 62*b*. Hence, an operator sees an "in alignment" condition along the first axis $A_1$ when making an inspection through the first opening 132. Alignment along the second axis $A_2$ is also proper as the third and fourth outer square-shaped boundary corners 64*c* and 64*d* are covered by the nozzle plate 32.

When the fiducial body 60 is viewed through the second opening 234, the nozzle plate 32 covers the outer square-shaped boundary corners 64*a* and 64*b* and, hence, those corners 64*a* and 64*b* cannot be seen. Hence, alignment along the first axis $A_1$ is proper. Alignment along the second axis $A_2$ is also proper as the third and fourth outer square-shaped boundary corners 64*c* and 64*d* are covered by the nozzle plate 32.

Accordingly, it should be apparent from the example illustrated in FIG. 13 that an accurate determination of alignment between the nozzle plate 32 and the heater chip 22 will be made even if the inspection opening has X and Y dimensions which are equal to the inspection opening lower limit values.

In the illustrated embodiment, first, second, third and fourth alternative fiducial portions 250–253 are provided on the chip 22, see FIG. 5. The nozzle plate opening 34 provided in the nozzle plate 32 for use in combination with the fiducial portions will be smaller than the opening 34 used in combination with the fiducials 50–53. The fiducial portion 250–253 are used when a smaller or tighter inspection criteria along each of the first and second axes $A_1$ and $A_2$ is desired.

The fiducial portions 250–253 comprise portions of a second fiducial body 200, see FIG. 5. The second body 200 is defined by the inner square-shaped boundary 62 and a center boundary 264 shaped like a plus "+" sign. The inner and center boundaries 62 and 264 may be of any geometric shape.

The first fiducial portion 250 extends from a first corner 62*a* of the inner square-shaped boundary 62 to a first corner 264*a* of the center boundary 264. The second fiducial portion 251 extends from a second corner 62*b* of the inner square-shaped boundary 62 to a second corner 264*b* of the center boundary 264. The third fiducial portion 252 extends from a third corner 62*c* of the inner square-shaped boundary 62 to a third corner 264*c* of the center boundary 264. The fourth fiducial portion 253 extends from a fourth corner 62*d* of the inner square-shaped boundary 62 to a fourth corner 264*d* of the center boundary 264. The first and second fiducial portions 250 and 251 are located along the first axis $A_1$. The third and fourth fiducial portions 252 and 253 are located along the second axis $A_2$.

Each of the first and second fiducial portions 250 and 251 has a length $L_3$ which is equal to approximately twice an acceptable dimension or tolerance by which the nozzle plate 32 may be offset relative to the heater chip 22 in a direction along the first axis $A_1$, see FIG. 12. Each of the third and fourth fiducial portions 252 and 253 has a length $L_4$ which is equal to approximately twice an acceptable dimension by which the nozzle plate 32 may be offset relative to the heater chip 22 in a direction along the second axis $A_2$. $L_3$ may be equal to $L_4$ or may be less than or greater than $L_4$.

The distance $D_3$ between a midpoint $M_5$ on the first fiducial portion 250 and a midpoint $M_6$ on the second fiducial portion 251 is approximately equal to the lower limit dimension of the X dimension of the inspection opening 34, see FIG. 12. The distance $D_4$ between a midpoint $M_7$ on the third fiducial portion 252 and a midpoint $M_8$ on the fourth fiducial portion 253 is approximately equal to the lower limit dimension of the Y dimension of the inspection opening 34.

Example dimensions will now be set out for the fiducial portions 250–253 and for an inspection opening 34 to be used in conjunction with the fiducial portions 250–253. These dimensions are being presented for purposes of illustration only and are not limiting. The first and second dimensions X and Y of the inspection opening 34 are each equal to 66±4 microns. Thus, the first dimension X has a nominal dimension of 66 microns, a lower limit dimension of 62 microns and an upper limit dimension of 70 microns. The second dimension Y has a nominal dimension of 66 microns, a lower limit dimension of 62 microns and an upper limit dimension of 70 microns. The length $L_3$ of each of the first and second fiducial portions 250 and 251 is equal to 14 microns and the length $L_4$ of each of the third and fourth fiducial portions 252 and 253 is equal to 14 microns. Thus, in this example, the acceptable distance by which the nozzle plate 32 may be offset relative to the heater chip 22 along either the $A_1$ axis or the $A_2$ axis is approximately 7 microns.

The fiducial portions 250–253 are viewed through the inspection opening 34 using a microscope in the same manner as discussed above with regard to the viewing of the fiducial portions 250–253 through the inspection opening 34. A determination is then made from the location of the first, second, third and fourth fiducial portions 250–253 and the first, second, third and fourth edges 34*a*–34*d* of the inspection opening 34 whether the heater chip 22 and the nozzle plate 32 are properly aligned relative to one another.

The alignment determination involves three inquiries which are similar to those discussed above. The first inquiry is whether the first, second, third and fourth inner square-shaped boundary corners 62*a*–62*d* are covered by the nozzle plate 32. If all of the inner square-shaped boundary corners 62*a*–62*d* are covered by the nozzle plate 32 and, hence, are not visible through the inspection opening 34, then the alignment between the heater chip 22 and the nozzle plate 32 is acceptable and no further inquiries need be made. If the first and second inner square-shaped boundary corners 62*a* and 62*b* are covered by the nozzle plate 32 and one of the third and fourth inner square-shaped boundary corners 62*c* and 62*d* is not covered by the nozzle plate 32, then alignment is proper along the first axis $A_1$ and a second inquiry must be made regarding alignment along the second axis $A_2$. If the third and fourth inner square-shaped boundary corners 62*c* and 62*d* are covered by the nozzle plate 32 and one of the first and second inner square-shaped boundary corners 62*a* and 62*b* is not covered by the nozzle plate 32, then alignment is proper along the second axis $A_2$ and a second inquiry must be made regarding alignment along the first axis $A_1$. If one of the first and second inner square-shaped boundary corners 62*a* and 62*b* is not covered by the nozzle plate 32 and one of the third and fourth inner square-shaped boundary corners 62*c* and 62*d* is not covered by the nozzle plate 32, then a second inquiry must be made regarding alignment along both the first and second axes $A_1$ and $A_2$.

The second inquiry is whether the nozzle plate 32 covers any portion of any one of the center boundary corners 264*a*–264*d*. If the nozzle plate 32 covers one of the first and second center corners 264*a* or 264*b*, then alignment is improper along the first axis $A_1$. If the nozzle plate 32 covers one of the third and fourth center corners 264*c* or 264*d*, then alignment is improper along the second axis $A_2$. The nozzle plate 32 is improperly aligned relative to the heater chip 22 if alignment is improper along either the first axis $A_1$ or the second axis $A_2$. If the nozzle plate 32 does not cover any portion of any one of the center corners 264*a*–264*d*, then a third inquiry is made.

The third inquiry in performed with regard to one or both of the $A_1$ and $A_2$ axes. The inquiry is whether a gap or distance between one inspection opening edge and a visible inner square-shaped boundary corner is greater than, equal to or less than a gap or distance between an opposing inspection opening edge and an opposing center corner. The alignment is acceptable along the direction being evaluated if the gap between the one inspection opening edge and the visible inner square-shaped boundary corner is less than or equal to the gap between the opposing inspection opening edge and the opposing center boundary corner. The alignment is unacceptable if the gap between the one inspection opening edge and the visible inner square-shaped boundary corner is greater than the gap between the opposing inspection opening edge and the opposing center boundary corner.

It is further contemplated that only one set of fiducial portions or three or more sets of fiducial portions may be provided on the heater chip 22.

It is also contemplated that a plurality of fiducial portions may be spaced anywhere on the surface of the heater chip 22. For example, one set of fiducial portions may be placed at one end of the chip and another set of fiducials may be placed at the opposite end of the chip.

It is additionally contemplated that the fiducial portions may comprise spaced-apart solid or dotted lines instead of forming part of a single fiducial body.

It is still further contemplated that a substantially square line or recess (also referred to herein as an "inspection reference section") may be scribed into the nozzle plate or otherwise formed or positioned on the nozzle plate, which plate is partially transparent. The line is made instead of forming an inspection opening in the nozzle plate. The line may be rectangular or may have any other geometric shape. Further, it is preferably formed in or positioned on the bottom surface of the nozzle plate, i.e., the surface positioned adjacent to the heater chip. As the nozzle plate is substantially transparent, the line is used during alignment determination in place of inspection opening edges.

With regard to the fiducial portions 50–53, it is alternatively contemplated that alignment may be considered unacceptable if the gap between one inspection opening edge and a visible outer square-shaped boundary corner is equal to the gap between an opposing inspection opening edge and an opposing inner-square shaped boundary corner. Likewise, with regard to the alternative fiducial portions 250–253, it is alternatively contemplated that alignment may be considered unacceptable if the gap between one inspection opening edge and a visible inner square-shaped boundary corner is equal to the gap between an opposing inspection opening edge and an opposing center boundary corner.

The ink jet printhead 40 comprises part of an ink jet print cartridge. The print cartridge further comprises a reservoir (not shown) such as a polymeric container which is filled with ink. The reservoir may be refilled with ink.

What is claimed is:

1. A fiducial system adapted for use during an alignment inspection of first and second adjacent elements, said fiducial system comprising:

an inspection opening in said second element; and first and second fiducial portions on said first element positioned and sized to provide an accurate indication when viewed through said inspection opening of whether said second element is properly positioned relative to said first element regardless of the size of said inspection opening as long as said opening has a size greater than or equal to a lower limit dimension, wherein said first and second fiducial portions are located along a common axis and each of said first and second fiducial portions has a length which is equal to approximately twice an acceptable dimension by which said second element may be offset relative to said first element in a direction along said common axis.

2. A fiducial system as set forth in claim 1, wherein said first and second fiducial portions comprise portions of a single fiducial body provided on said first element.

3. A fiducial system as set forth in claim 2, wherein said fiducial body has generally inner and outer square-shaped boundaries, said first fiducial portion extends from a first corner of said outer square-shaped boundary to a first corner of said inner square-shaped boundary and said second fiducial portion extends from a second corner of said outer square-shaped boundary to a second corner of said inner square-shaped boundary.

4. A fiducial system as set forth in claim 1, wherein the distance between a midpoint on said first fiducial portion and a midpoint on said second fiducial portion is approximately equal to said lower limit dimension of said inspection opening.

5. A fiducial system as set forth in claim 1, wherein said fiducial system and said first and second elements are an ink jet printhead.

6. A fiducial system as set forth in claim 1, wherein said first element comprises a silicon-comprising substrate.

7. A fiducial system as set forth in claim 6, wherein said silicon-comprising substrate is an ink jet heater chip.

8. A fiducial system as set forth in claim 1, wherein said second element is an ink jet nozzle plate.

9. A fiducial system as set forth in claim 1, wherein said fiducial system and said first and second elements form part of an ink jet print cartridge.

10. A fiducial system as set forth in claim 9, wherein said ink jet print cartridge further comprises a reservoir provided with ink.

11. A fiducial system as set forth in claim 10, wherein said reservoir may be refilled with ink.

12. A fiducial pattern located on a surface of a first element adapted for use during an inspection to determine if an adjacent second element including an inspection opening is properly positioned relative to said first element, said fiducial pattern comprising first and second fiducial portions sized so as to provide an accurate indication when viewed through said inspection opening of whether said second element is properly positioned relative to said first element regardless of the size of said inspection opening as long as said inspection opening has a size which is greater than or equal to a lower limit dimension, wherein said first and second fiducial portions comprise portions of a single fiducial body provided on said first element and said fiducial body has generally inner and outer square-shaped boundaries said first fiducial portion extends from a first corner of said outer square-shaped boundary to a first corner of said inner square-shaped boundary and said second fiducial portion extends from a second corner of said outer square-shaped boundary to a second corner of said inner square-shaped boundary.

13. A fiducial pattern as set forth in claim 12, wherein said first and second fiducial portions are located along a common axis.

14. A fiducial pattern as set forth in claim 13, wherein each of said first and second fiducial portions has a length which is equal to approximately twice an acceptable tolerance said second element may be offset relative to said first element in a direction along said common axis.

15. A fiducial pattern as set forth in claim 12, wherein the distance between a midpoint on said first fiducial portion and a midpoint on said second fiducial portion is approximately equal to said lower limit dimension of said inspection opening.

16. A fiducial pattern as set forth in claim 12, wherein said first element comprises an ink jet printhead heater chip.

17. A fiducial pattern located on a surface of a first element comprising first and second fiducial portions which are adapted to be used during an inspection to determine if a second element having an inspection opening of a first size is properly positioned relative to said first element in accordance with a first inspection criterion and third and fourth fiducial portions which are adapted to be used during an inspection to determine if a second element having an inspection opening of a second size is properly positioned relative to said first element in accordance with a second inspection criterion which differs from said first inspection criterion, wherein said first, second, third and fourth fiducial portions are located along a common axis and each of said first and second fiducial portions has a length which is equal to approximately twice an acceptable dimension by which said second element having said opening of said first size may be offset relative to said first element in a direction along said common axis so as to be in accordance with said first inspection criterion, and each of said third and fourth fiducial portions has a length which is equal to approximately twice an acceptable dimension by which said second element having said opening of said second size may be offset relative to said first element in a direction along said common axis so as to be in accordance with said second inspection criterion.

18. A fiducial pattern as set forth in claim 17, wherein said first and second fiducial portions comprise portions of a first fiducial body and said third and fourth fiducial portions comprise portions of a second fiducial body.

19. A fiducial pattern located on a surface of a first element adapted for use during an inspection to determine if a second element is properly positioned relative to said first element, said fiducial pattern comprising first and second fiducial portions sized so that each has a length approximately equal to twice an inspection criterion, wherein said inspection criterion is equal to an acceptable dimension by which said second element may be offset relative to said first element in a direction along a given axis.

20. A fiducial pattern as set forth in claim 19, wherein said first element comprises an ink jet printhead heater chip.

21. A method for conducting an inspection to determine if a second element is properly aligned relative to a first element, the method comprising the steps of:

providing an inspection opening in said second element;

providing first and second fiducial portions on said first element which are sized so as to provide an indication when viewed through said inspection opening of whether said second element is properly positioned relative to said first element regardless of the size of said inspection opening as long as said opening has a size greater than or equal to a lower limit dimension;

viewing said first and second fiducial portions through said inspection opening; and determining from the location of said first and second fiducial portions relative to at least one edge of said inspection opening whether said first and second elements are properly aligned relative to one another, wherein said step of providing first and second fiducial portions comprises the step of providing a fiducial body having generally inner and outer square-shaped boundaries such that said first fiducial portion extends from a first corner of said outer square-shaped boundary to a first corner of said inner square-shaped boundary and said second fiducial portion extends from a second corner of said outer square-shaped boundary to a second corner of said inner square-shaped boundary.

22. A method as set forth in claim 21, wherein said determining step comprises the step of determining whether a gap between a first inspection opening edge and a visible outer square-shaped boundary corner is greater than, equal to or less than a gap between a second inspection opening edge and an opposite inner square-shaped boundary corner, said alignment being acceptable if said gap between said first inspection opening edge and said visible outer square-shaped boundary corner is less than or equal to said gap between said second inspection opening edge and said opposite inner square-shaped boundary corner, and said alignment being unacceptable if said gap between said first inspection opening edge and said visible outer square-shaped boundary corner is greater than said gap between said second inspection opening edge and said opposite inner square-shaped boundary corner.

23. A method as set forth in claim 22, wherein said determining step further comprises the step of determining if all of said outer square-shaped boundary corners are covered by said second element, said alignment being acceptable if all of said outer square-shaped boundary corners are covered by said second element.

24. A method as set forth in claim 23, wherein said determining step further comprises the step of determining if said second element covers any portion of one of said inner square-shaped boundary corners, said alignment being unacceptable if said second element covers any portion of one of said inner square-shaped boundary corners.

25. A method as set forth in claim 21, wherein said step of providing first and second fiducial portions on said first element comprises the steps of forming a metal layer on said first element and etching away portions of said metal layer so as to form said first and second fiducial portions.

26. A fiducial pattern located on a surface of an ink jet printhead heater chip adapted for use during an inspection to determine if a nozzle plate is properly positioned relative to said heater chip, said fiducial pattern comprising first and second fiducial portions which are sized so that each has a length which is approximately equal to twice an inspection criterion, wherein said inspection criterion is equal to an acceptable dimension by which said nozzle plate may be offset relative to said heater chip in a direction along a given axis.

27. A fiducial system adapted for use during an alignment inspection of first and second adjacent elements, said fiducial system comprising:

an inspection reference section associated with said second element; and first and second fiducial portions on said first element positioned and sized to provide an accurate indication when viewed relative to said inspection reference section of whether said second element is properly positioned relative to said first element regardless of the size of said inspection reference section, wherein said reference section comprises a scribed line on said second element.

28. A fiducial system adapted for use during an alignment inspection of first and second adjacent elements, said fiducial system comprising:

an inspection opening in said second element; and first and second fiducial portions on said first element positioned and sized to provide an accurate indication when viewed through said inspection opening of whether said second element is properly positioned relative to said first element regardless of the size of said inspection opening as long as said opening has a size greater than or equal to a lower limit dimension; wherein said first and second fiducial portions comprise positions of a single fiducial body provided on said first element and said fiducial body has generally inner and outer square-shaped boundaries, said first fiducial portion extends from a first corner of said outer square-shaped boundary to a first corner of said inner square-shaped boundary and said second fiducial portion extends from a second corner of said outer square-shaped boundary to a second corner of said inner square-shaped boundary.

29. A fiducial system adapted for use during an alignment inspection of first and second adjacent elements, said fiducial system comprising:

an inspection opening in said second element; and first and second fiducial portions on said first element positioned and sized to provide an accurate indication when viewed through said inspection opening of whether said second element is properly positioned relative to said first element regardless of the size of said inspection opening as long as said opening has a size greater than or equal to a lower limit dimension, wherein the distance between a midpoint on said first fiducial portion and a midpoint of said second fiducial portion is approximately equal to said lower limit dimension of said inspection opening.

30. A fiducial pattern located on a surface of a first element adapted for use during an inspection to determine if an adjacent second element including an inspection opening is properly positioned relative to said first element, said fiducial pattern comprising first and second fiducial portions sized so as to provide an accurate indication when viewed through said inspection opening of whether said second element is properly positioned relative to said first element regardless of the size of said inspection opening as long as said inspection opening has a size which is greater than or equal to a lower limit dimension, wherein said first and second fiducial portions are located along a common axis and each of said first and second fiducial portions has a length which is equal to approximately twice an acceptable tolerance said second element may be offset relative to said first element in a direction along said common axis.

31. A fiducial pattern located on a surface of a first element adapted for use during an inspection to determine if an adjacent second element including an inspection opening is properly positioned relative to said first element, said fiducial pattern comprising first and second fiducial portions sized so as to provide an accurate indication when viewed through said inspection opening of whether said second element is properly positioned relative to said first element regardless of the size of said inspection opening as long as said inspection opening has a size which is greater than or equal to a lower limit dimension, wherein the distance between a midpoint on said first fiducial portion and a midpoint on said second fiducial portion is approximately equal to said lower limit dimension of said inspection opening.

32. A fiducial system adapted for use during an alignment inspection of first and second adjacent elements, said fiducial system comprising:

an inspection reference section associated with said second element; and first and second fiducial portions on said first element positioned and sized to provide an accurate indication when viewed relative to said inspection reference section of whether said second element is properly positioned relative to said first element regardless of the size of said inspection reference section, wherein said reference section comprises a square shaped scribed line on a surface of said second element positioned adjacent to said first element.

* * * * *